US011641957B2

(12) United States Patent
Phillips et al.

(10) Patent No.: US 11,641,957 B2
(45) Date of Patent: May 9, 2023

(54) MAGNETIC FRAMING SYSTEM

(71) Applicant: Tracer Imaging LLC, Ossining, NY (US)

(72) Inventors: Charles Phillips, White Plains, NY (US); Steven M. Spiro, Chappaqua, NY (US)

(73) Assignee: TRACER IMAGING LLC, Ossining, NY (US)

( * ) Notice: Subject to any disclaimer, the term of this patent is extended or adjusted under 35 U.S.C. 154(b) by 0 days.

(21) Appl. No.: 17/140,254

(22) Filed: Jan. 4, 2021

(65) Prior Publication Data

US 2021/0204724 A1 Jul. 8, 2021

Related U.S. Application Data

(60) Provisional application No. 62/957,589, filed on Jan. 6, 2020, provisional application No. 62/957,195, filed on Jan. 4, 2020.

(51) Int. Cl.
*A47G 1/17* (2006.01)
*A47G 1/06* (2006.01)

(52) U.S. Cl.
CPC ..... *A47G 1/17* (2013.01); *A47G 2001/0672* (2013.01)

(58) Field of Classification Search
CPC .... A47G 1/17; A47G 2001/0672; A47G 1/06; A47G 2001/0694; A47G 1/142; A47G 1/168; A47G 1/1606
USPC ..... 248/206.5, 682, 467
See application file for complete search history.

(56) References Cited

U.S. PATENT DOCUMENTS

| | | | | |
|---|---|---|---|---|
| 4,605,292 | A * | 8/1986 | McIntosh | A47G 1/00 428/912.2 |
| 6,692,807 | B2 | 2/2004 | Bries et al. | |
| 6,889,458 | B2 | 5/2005 | Copley | |
| 8,397,411 | B2 | 3/2013 | Russo et al. | |
| 9,920,783 | B2 * | 3/2018 | Runge | A47G 1/17 |
| 2005/0006552 | A1 * | 1/2005 | Giles | G09F 7/06 248/467 |
| 2011/0260020 | A1 * | 10/2011 | Isserow | G09F 3/10 248/205.3 |
| 2015/0342372 | A1 | 12/2015 | Chafe | |
| 2016/0073796 | A1 * | 3/2016 | Nesbitt | G09F 7/04 40/711 |
| 2016/0255970 | A1 * | 9/2016 | Pierson | A47G 1/17 |
| 2017/0220204 | A1 * | 8/2017 | Huang | G06F 3/042 |
| 2019/0390466 | A1 * | 12/2019 | Lautzenhiser | E04F 15/02144 |
| 2021/0204724 | A1 * | 7/2021 | Phillips | A47G 1/142 |

* cited by examiner

*Primary Examiner* — Muhammad Ijaz
(74) *Attorney, Agent, or Firm* — Leason Ellis LLP

(57) ABSTRACT

A repositionable frame system includes a repositionable wall mount configured for being repositionably secured to a support surface. The repositionable wall mount includes a first magnetic element. The system further includes a frame having a rear face that includes a second magnetic element that is magnetically attracted to the first magnetic element resulting in a magnetic coupling between the frame and the repositionable wall mount.

18 Claims, 12 Drawing Sheets

MAGNETIC FRAMING SYSTEM

CROSS REFERENCE TO RELATED APPLICATIONS

The present application claims the benefit of and priority to U.S. patent application Ser. No. 62/957,195, filed Jan. 4, 2020 and U.S. patent application Ser. No. 62/957,589, filed Jan. 6, 2020, each of which is hereby incorporated by reference in its entirety.

TECHNICAL FIELD

The present disclosure is directed to a frame for displaying an object, such as a photograph or artwork, and more particularly, relates to a framing (frame) system or assembly that includes magnetic attraction for attaching the frame to a support surface, such as a wall, while permitting easy repositioning of the frame, as well as an accessory for mounting a plurality of the framing systems.

BACKGROUND

For hundreds of years it's been customary to display photographs on walls enclosed in picture frames. The design of these frames has virtually remained unchanged, consisting of a wooden molding outer frame with enclosed backer board, upon which is photograph is placed covered in part at the edges with a chipboard mat with bevel cut opening, covered by a pane of glass. A wire line draped from edge to edge on the backside of the frame is then used to hang the frames on a nail/hook or screw imbedded into the wall.

It's now desirable to have a picture frame product that is inexpensive, unbreakable, light weight and provides a non-wall-damaging displaying and repositioning system. More people are renting than ever before and deposits may be lost for damage done to wall. Also many Offices, Dorm Rooms and Rental apartments have restrictions against making holes in walls. Also there has been a recent growth in the popularity of Gridded Gallery Picture Walls that utilize multiple uniform sized frames arranged in a gridded fashion in rows and columns with equal spacing between frames. Achieving the proper spacing and positioning is a difficult task using traditional hanging systems with nails, hooks etc. and often results in creating multiple holes in the wall per frame, to finally achieve the intended target positioning.

SUMMARY

The presently disclosed framing system has many advantages relative to traditional frames. Firstly, it enables the easy non-damaging wall mounting of frames and subsequent repositioning in both vertical and horizontal positions without removal from the wall. Users will merely position and adhere the framing system to a wall by utilizing the frame's magnetic/adhesive wall attachment system that is described herein and illustrated herein.

BRIEF DESCRIPTION OF THE DRAWING FIGURES

DETAILED DESCRIPTION OF CERTAIN EMBODIMENTS

In accordance with the present disclosure, as illustrated in the attached figures, a framing system or assembly (kit) is shown. The framing system is formed generally of two parts, namely, a first part or part A and a second part or part B.

Figure 1:
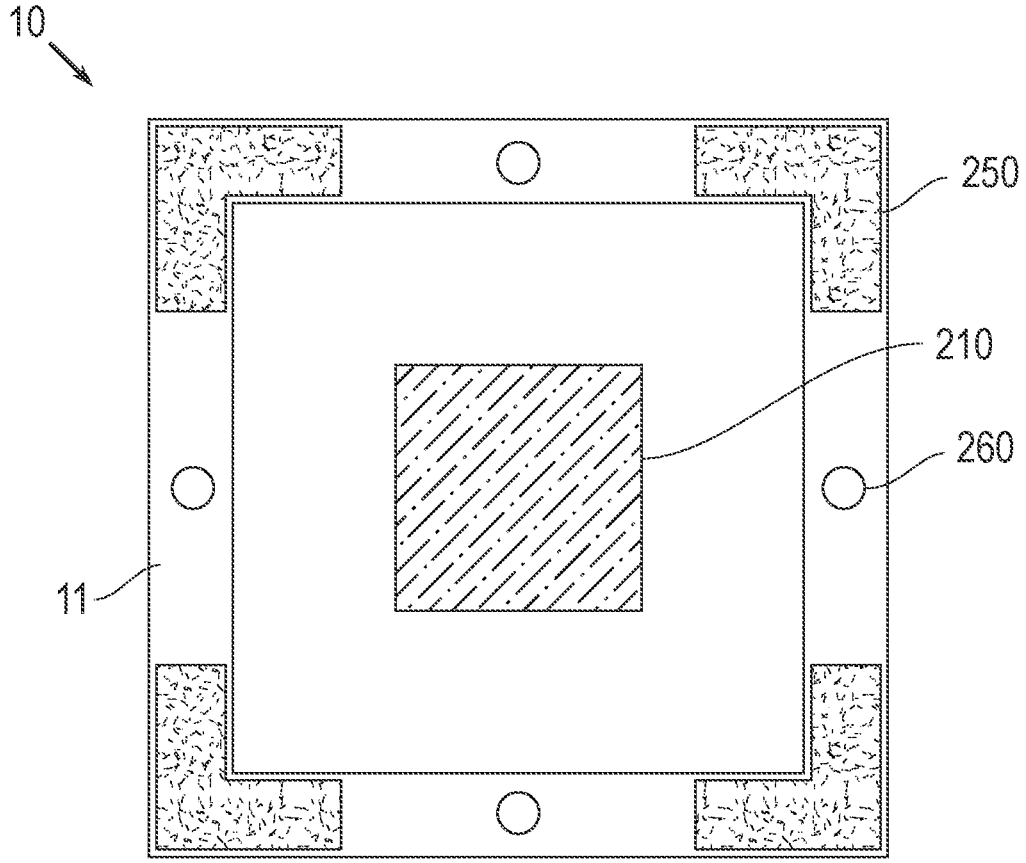
FIG. 1 is a rear view of a magnetic framing system.
Figure 2:
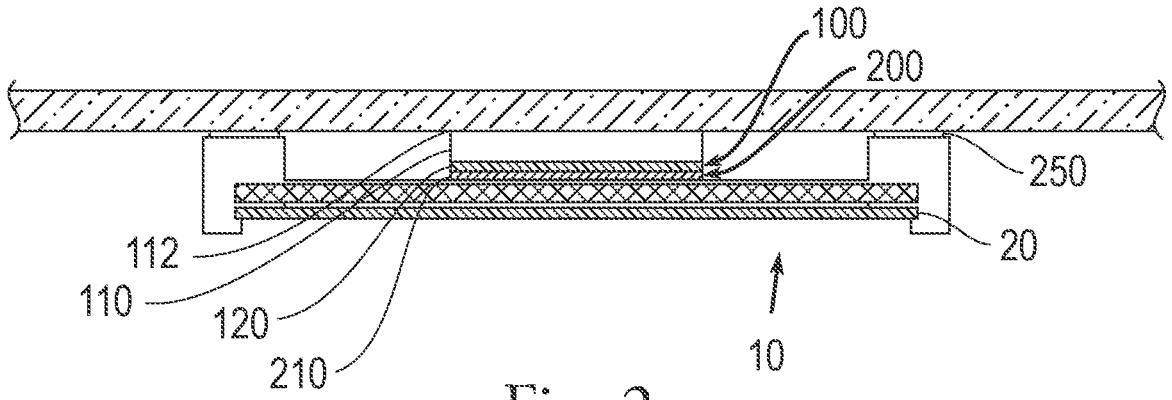
FIG. 2 is a side cross-sectional view thereof.

Part A represents the part of the framing system that is configured for attachment to the support surface (e.g., a wall), while part B represents the frame itself that is detachably and repositionably coupled to part A. In FIGS. 1 and 2, part A is identified at 100 and part B is identified at 200. The framed article or frame is identified at 10 in the figures. As shown in FIG. 2, the frame 10 includes a border frame 11 (connected rails) and can include other conventional parts such as a corrugated backer board, a mounting board with adhesive, as well as the image 20 (e.g., a photograph) to be displayed.

Part A (100)

A repositionable adhesive is utilized to attach part A of the two-part wall mountable framing system to the wall. For purposes of this example, the part A assembly can have a 3"×3" footprint and can consist of a sheet of plastic carrier film coated with a repositionable adhesive on side one, which will be used to adhere the part A of the framing system to the wall. Side two of the carrier film is coated with a permanent adhesive which will bond the film to side 1 of a magnetic member. The magnetic member can be in the form of a 1/16" thickness, 3"×3" square foam rubber material 110 that can consist of a layer of foam and a magnetic rubber layer that is secured to the foam layer. Laminated to side two of the foam will preferably be a 3"×3" square of magnetic receptive rubber 120 with permanent adhesive (the magnetic receptive rubber 120 has ferrous material extruded into the rubber). Since it is formed of rubber, it is freely flexible and the foam provides a cushion effect. This arrangement is shown in the attached figure.

It will be understood that the aforementioned dimensions are merely exemplary in nature and part A and the components thereof can equally be formed to have other sizes. Size selection is performed at least in part in view of the size of part B (the frame itself).

In addition, while the attached figure shows a single part A, it will be understood that multiple part As can be used to secure the frame to the support surface (wall).

Part A thus provides a substrate that is secured to the support surface (wall) in a repositionable manner and provides a magnetically attractive surface that mates with a complementary magnetically attractive surface (part B) for detachably, yet securely mounting the frame to the wall. In order to provide the repositionable properties to the foam rubber 110, a repositional adhesive 112 is coated over the rear face of the foam rubber material 110 and is used to repositionably adhere part A to the support surface (wall).

Part B (200)

Part B is also 3"×3" and is permanently adhered to the backside of the frame which is generally identified at 10 in the figures. Part B generally comprises a flexible magnet 210, such as a magnetic rubber, with a permanent adhesive coating on one side to permanently attach it to the back panel of the frame 10 (e.g., picture frame). In general, flexible magnets are produced by a ferrite magnet material mixed with a flexible rubber binder which is then extruded or calendared to create profiles, tapes and sheets. Much like a standard refrigerator magnet, this type of magnet is easily flexed and can be bent.

To wall mount the framing system, part A is magnetically mated to part B which is permanently attached to the frame at the factory. The release liner covering the repositionable adhesive on part B is then removed exposing adhesive to attach the assembly to the wall by pressing the frame against the wall. Without removing the frame from the wall, repositioning is easily achieved in both vertical and horizontal directions by merely sliding the frame in desired direction, while being held on the wall by the magnetic attraction forces between part A attached to the wall and part B attached to the frame with adhesives.

This simple repositioning system enables gridded picture walls with uniform spacing between rows and columns of frames, to easily be created in a few minutes with no damage to walls. Creation of gridded picture walls utilizing traditional frames take hours and causes substantial wall damage in the process.

While part A is described as containing the ferrous material that is magnetically attracted to a permanent magnet that comprises part B, it will be understood that the opposite can be true in that part A can comprise the permanent magnet (e.g., a permanent magnet that is secured to the foam layer) and part B can comprise a ferrous material layer (e.g., a magnetic receptive rubber layer) that is attracted to the permanent magnet.

With reference to FIG. 2, it will be seen that the thickness of part A is selected in view of the position of magnetic element (e.g., magnetic rubber) of part B so that parts A and B are magnetically coupled to one another, while the frame itself is securely positioned against the wall such as by contact between a perimeter portion of the frame and the wall. In other words, the magnetic element on part B is offset a distance from the support wall due to its placement along a backing layer (e.g., corrugated backer board) that is itself offset from the support wall and therefore, the thickness of part A is selected so that placement of the frame against the support wall permits direct contact between the magnetic elements of parts A and B to ensure a secure magnetic coupling between parts A and B.

The following are the unique features of the framing system of the present disclosure:

1. Wall Mounting System:

The present framing system is specifically designed so that the back panel of the frame is flush or nearly with the surrounding frame. This enables attachment of a 3"×3" magnetic rubber material with permanent pressure sensitive adhesive that can be mated to a 3"×3" a magnetic receptive rubber pad adhered to the wall with a repositionable pressure sensitive adhesive. This magnetic receptive rubber pad is formed by laminating the magnetic rubber with permanent pressure sensitive adhesive to a thin foam material ideally of 1/16" thickness with repositionable adhesive on opposite side for adhering the assembly to the wall. The foam material enables maximum adhesive surface contact with the textured surfaces of walls created by the nap of paint roller applied paint.

The aforementioned magnetic receptive pad is easily peeled from the wall or other surface by merely lifting one edge a peeling the pliable assembly from the wall as you would adhesive tape. The pads may be removed and reapplied to the wall numerous times until the adhesive becomes contaminated and weakened by repeated applications and removals. Initially the mated 3"×3" pads are aligned with each other upon wall mounting, but another novel feature of the design is that once a frame is adhered to the wall in its intended target location using the magnetic/adhesive mounting system, the magnetic/adhesive system allows for adjustments in both vertical and horizontal directions without removing from the wall. This is achieved by sliding the frame left/right, or up/down while being held in place by the mounting assembly. Specially manufactured magnetic and magnetic receptive rubber materials both with matte surface finish will be utilized to maximize friction between the mating components to optimize holding properties for orientations. Glossy surface finish magnetic and receptive finished is most desired in industry and standard for manufacturers, but don't provide the desired friction for this application.

Since the magnetic rubber component is attached to the frame, frames can alternately be removed from the wall if desired and magnetically attached to a stand for displaying on desktops or alternatively attached to ferrous surfaces such as refrigerators or file cabinets.

The ability to easily adjust the frame positioning one wall mounted is especially advantageous for creating Gridded Gallery Picturewalls (see figures). Swapping of pictures frames is also easily achieved vs straight adhesive frame wall mounting systems where removable and reapplication cause deterioration of the adhesive strength properties.

Other wall mounting system presently exist which utilize double sided adhesive foam strips, but since the frame is rigid, one needs to break the adhesive bond between the wall and frame by pulling the frame away from the wall, since the frame inhibit the adhesive from being peelable. This peel forces therefore are more directly straight out from the wall which is greatly more likely to pull the painted sheet rock paper from the sheetrock. The pliability of the foam pad with laminated magnetic receptive material attached to the wall, utilized by the present frame attachment system, enables a gentle more gradual peeling process of the leading edge, which greatly diminishes the changes of causing wall damage.

Magnetic receptive rubber is made by mixing ferrous powder into the rubber during the manufacturing process and does not lose any of its magnetic receptive properties over time. Magnetic rubber is made in a similar fashion and has a higher density of ferrous material. After the extruding process, the material is magnetized by high strength magnetic. The amount of ferrous material is selected so that a secure magnetic coupling results between the parts A and B when the magnetic elements thereof are brought into contact.

Alternative configurations of the frame mounting system include: Utilizing the magnetic rubber on part A attached to the wall and the magnetic receptive material on part B attached to the frame, or magnetic rubber material on both components. Also, instead of one 3"×3" square mating parts on the 8"×8" frame, 2, 3 or more mating parts may be used for attaching larger frames to wall. Also mating magnetic strips may be used if desired with aforementioned foam rubber component. Holes 260 may be molded into each backside of the frame near the edge to permit a plastic peg to be inserted for desktop displaying.

Backside Depression

A depression can be molded into the backside of the frame in the event that frame is injection molded so that the magnetic rubber is flush with the back of the frame. As mentioned, the magnetic rubber can be As in all embodiments, the thickness of part A is chosen so that the magnetic elements of parts A and B contact one another to ensure a strong magnetic coupling.

Figure 3:
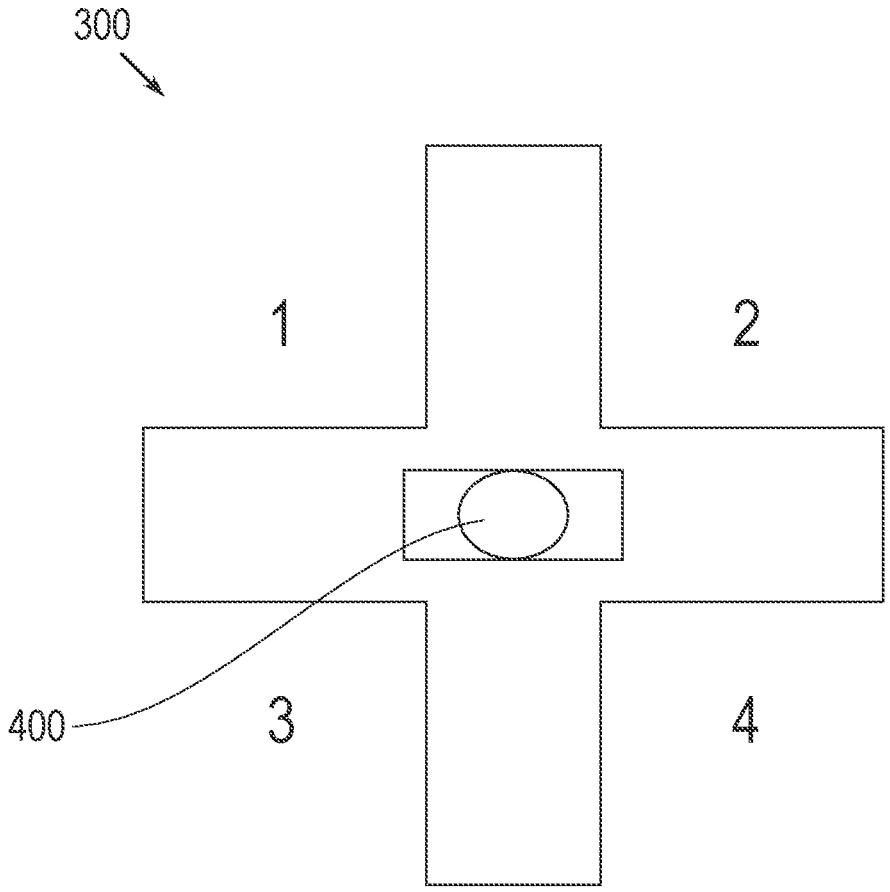
FIG. 3 is a front elevation view of an alignment tool.
Figure 4:
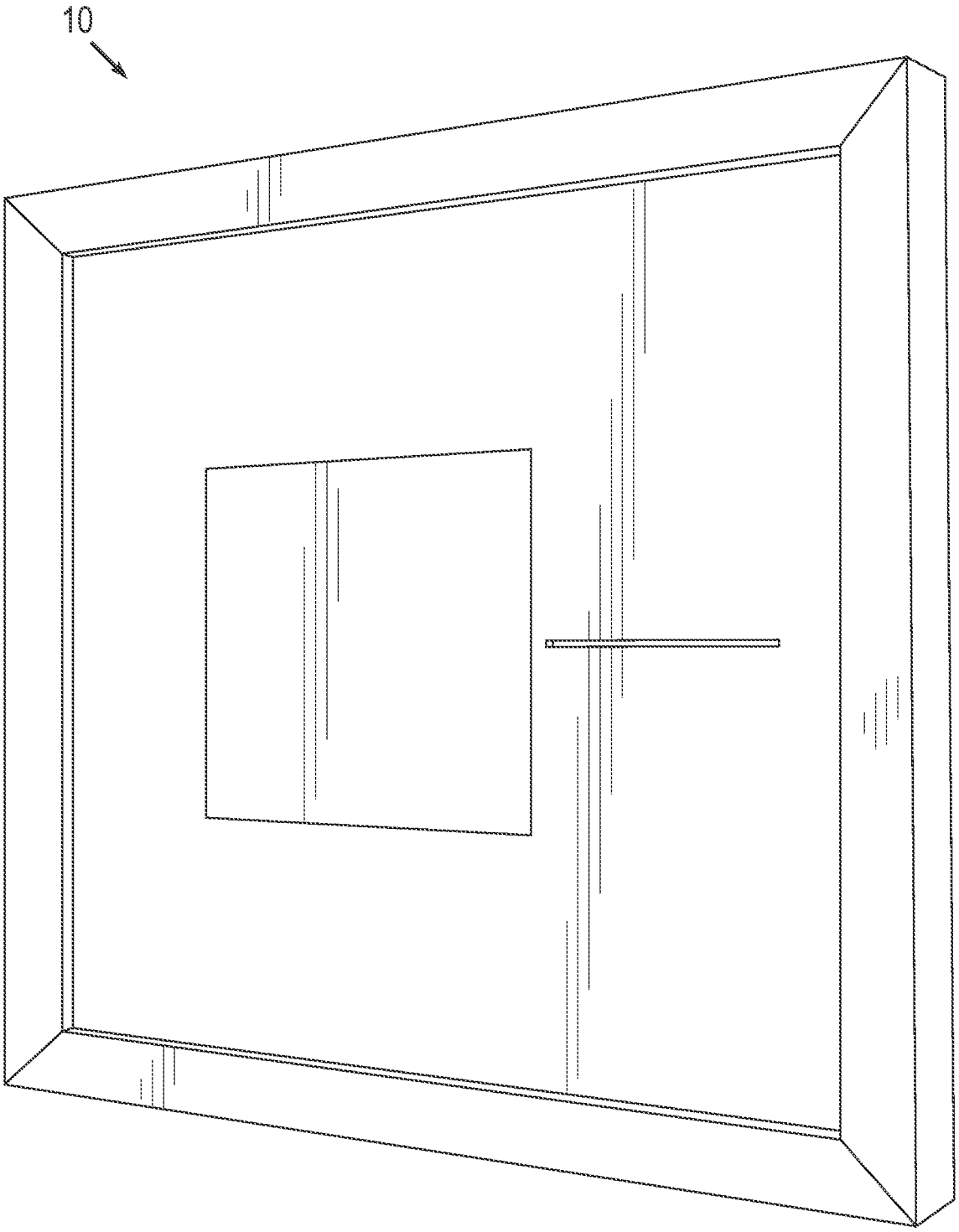
FIG. 4 is a rear perspective view thereof.
Figure 5:
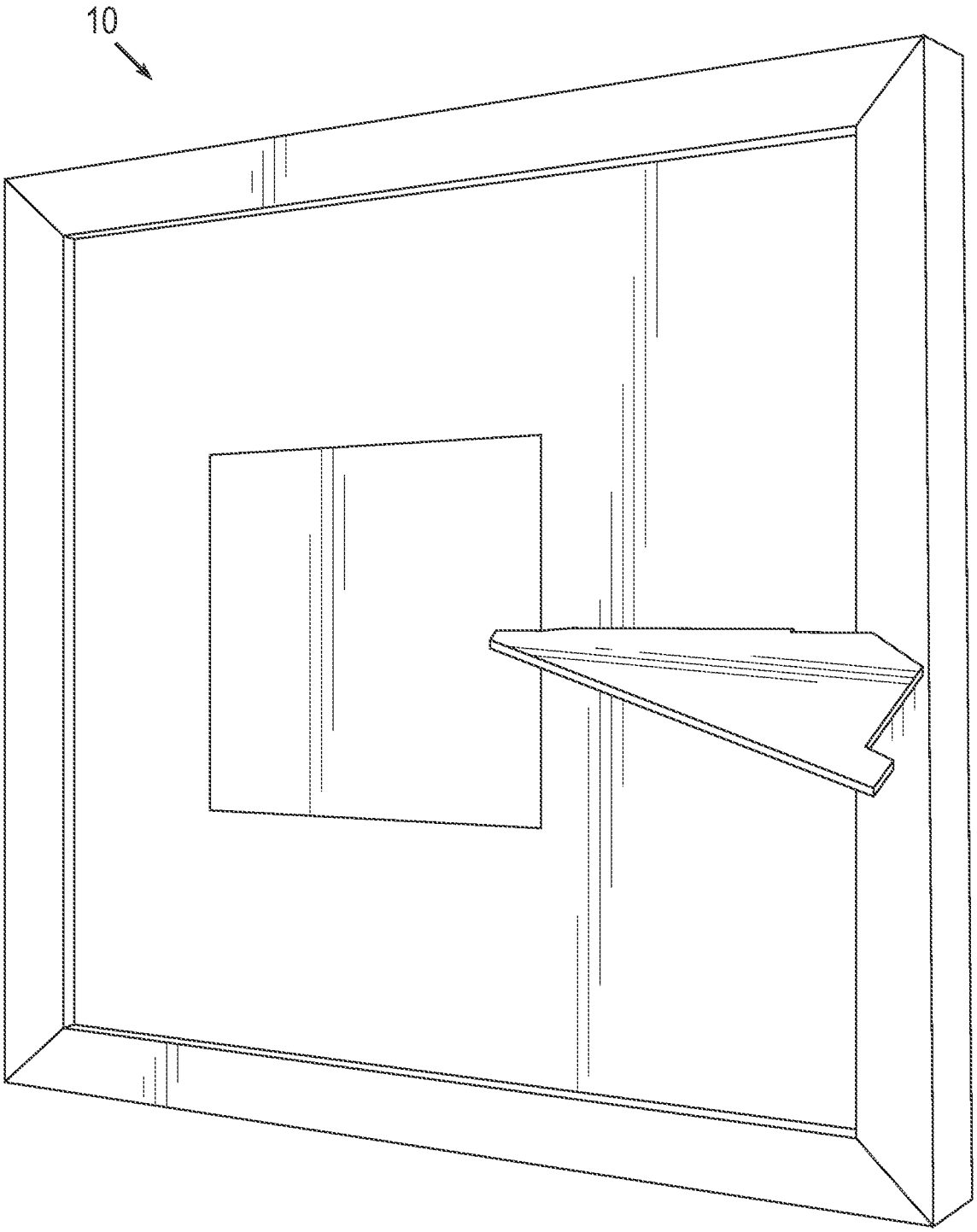
FIG. 5 is a rear perspective view thereof with an easel back in an extended position.
Figure 6:
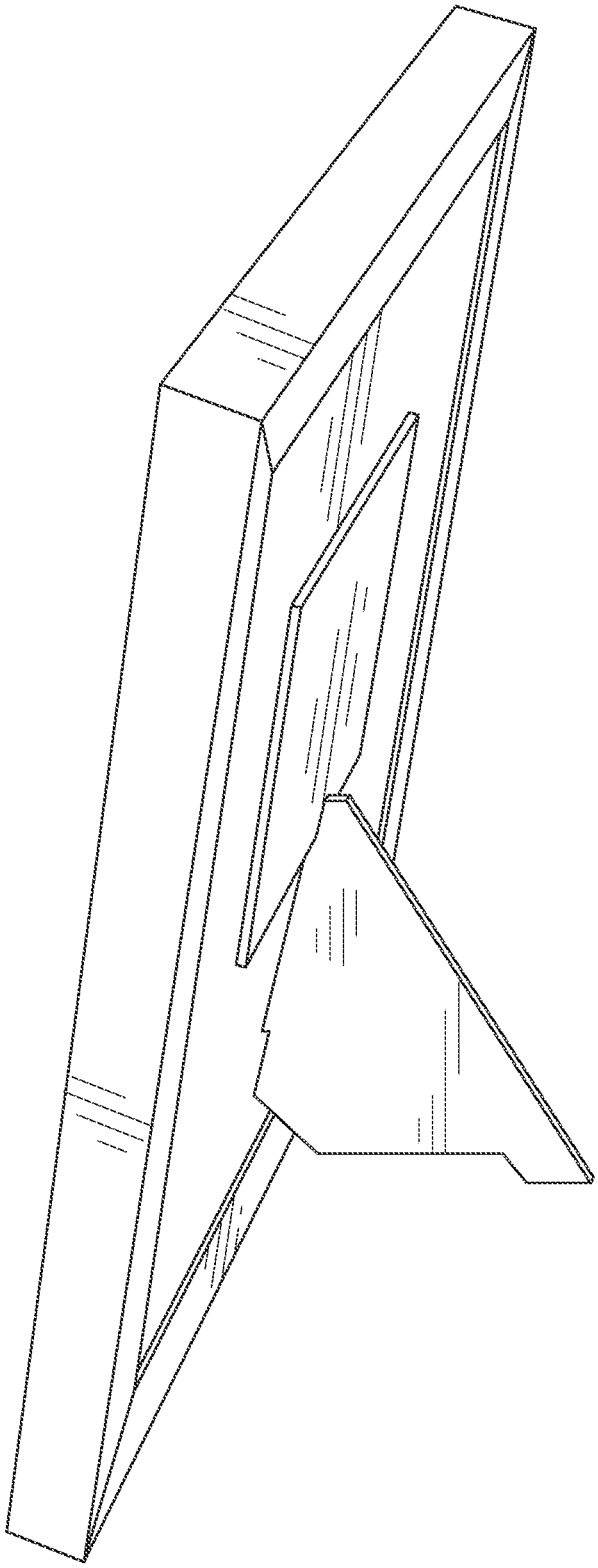
FIG. 6 is a side perspective view with the easel back in the extended position.
Figure 7:
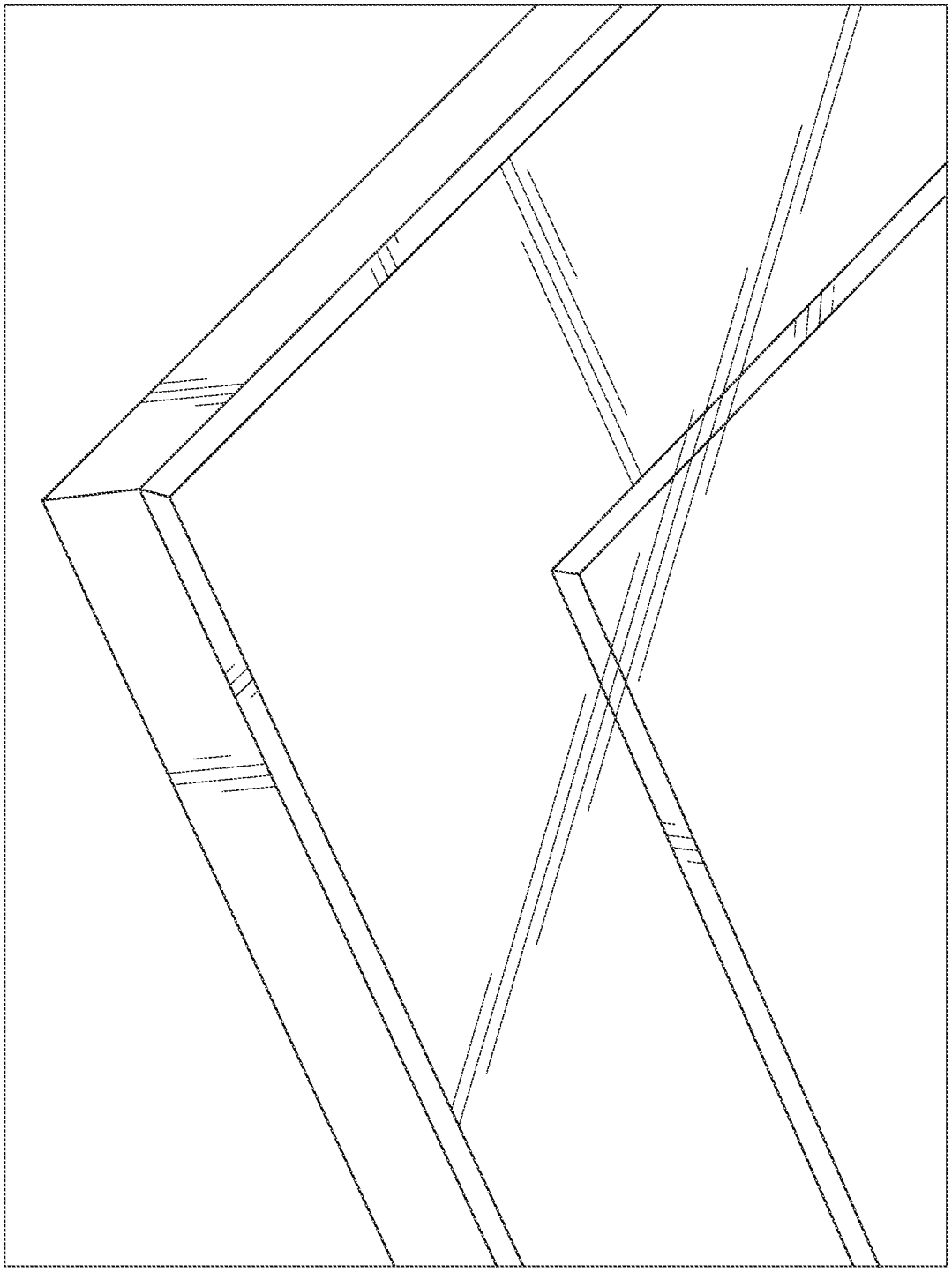
FIG. 7 is a perspective view of one corner of the magnetic framing system showing a faux mat.
Figure 8:
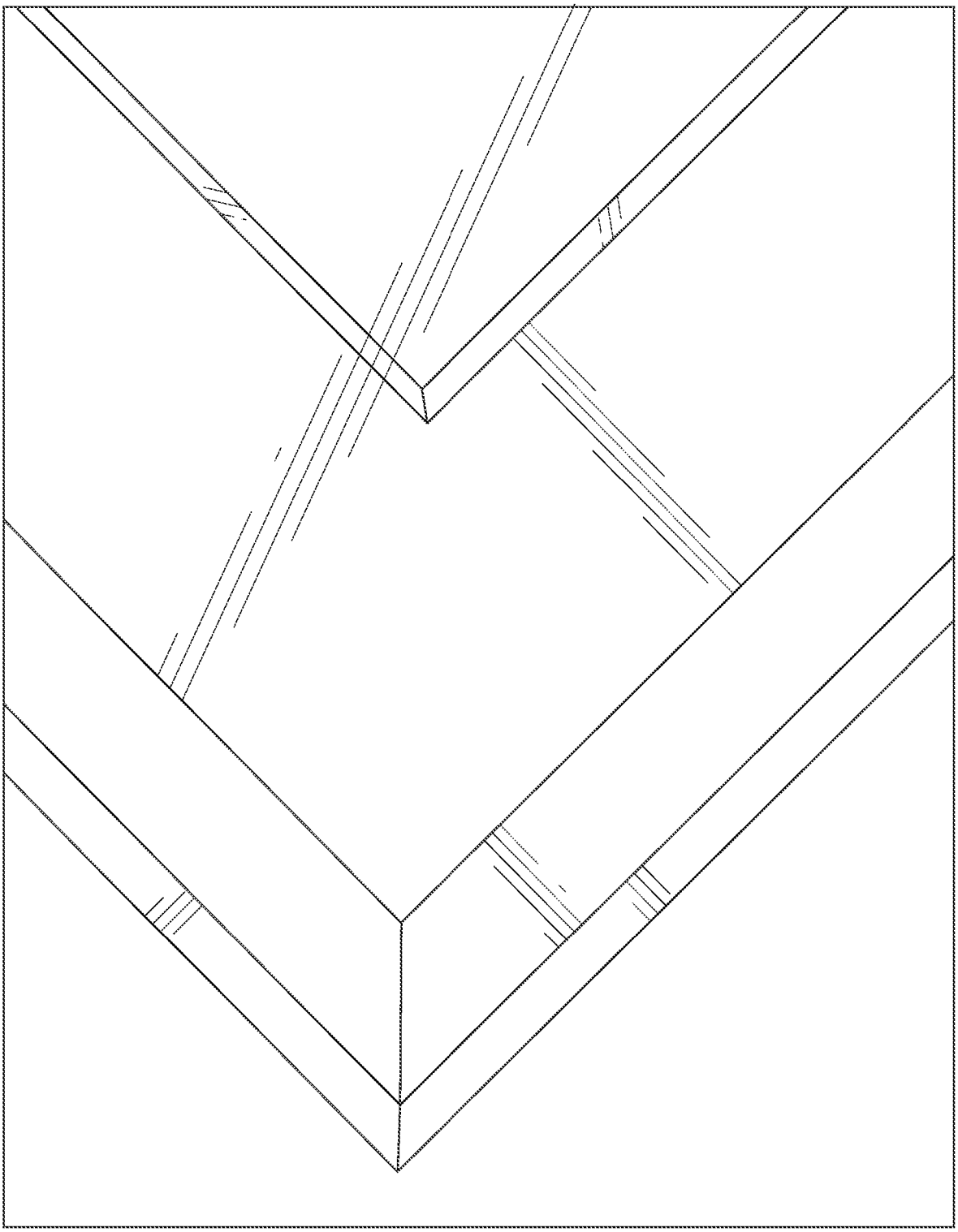
FIG. 8 is another view of the faux mat.
Figure 9:
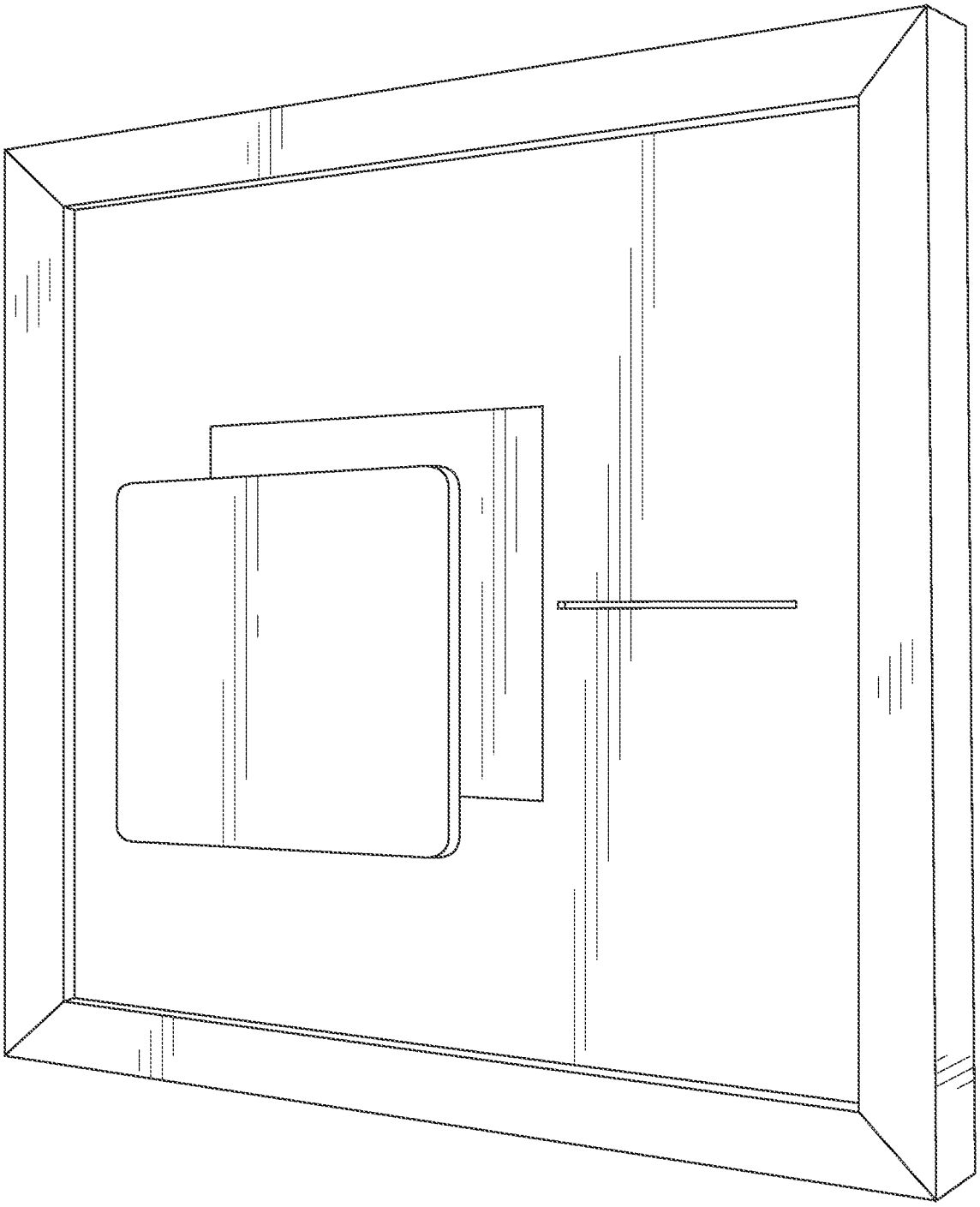
FIG. 9 is a rear perspective view of the magnetic framing system.
Figure 10:
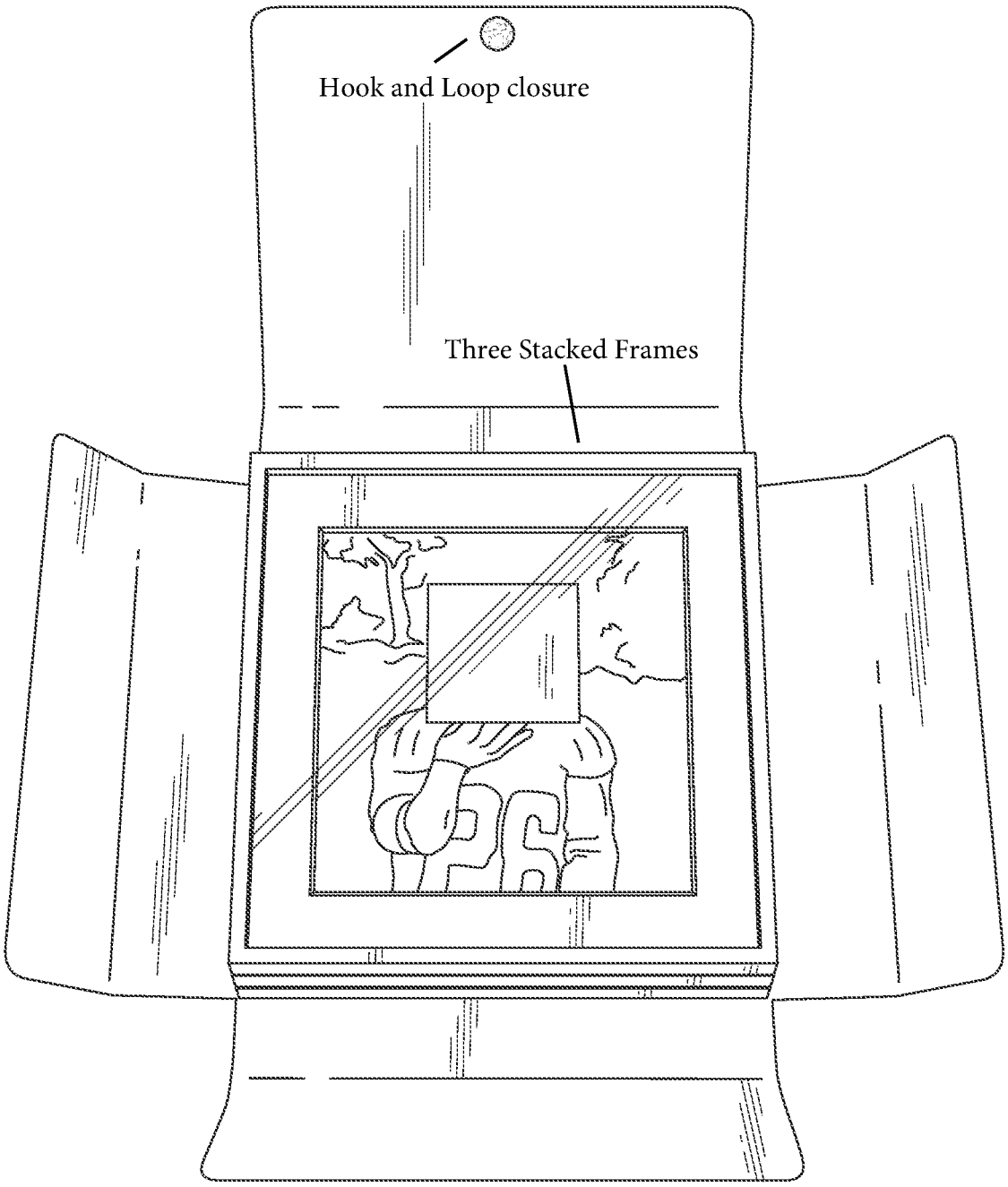
FIG. 10 is a top view of a box containing the magnetic framing system.
Figure 11:
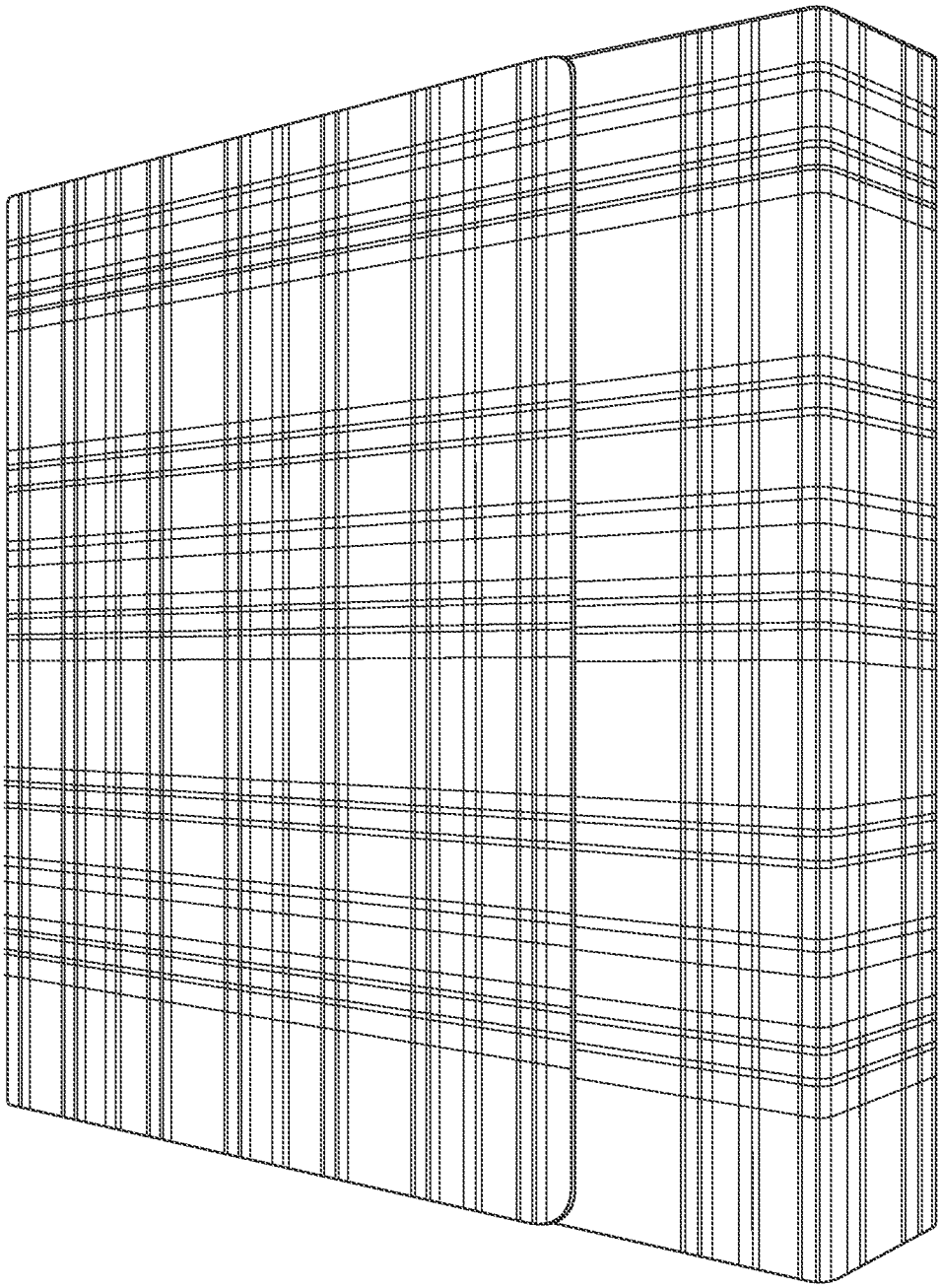
FIG. 11 is a top perspective view of the box closed.
Figure 12:
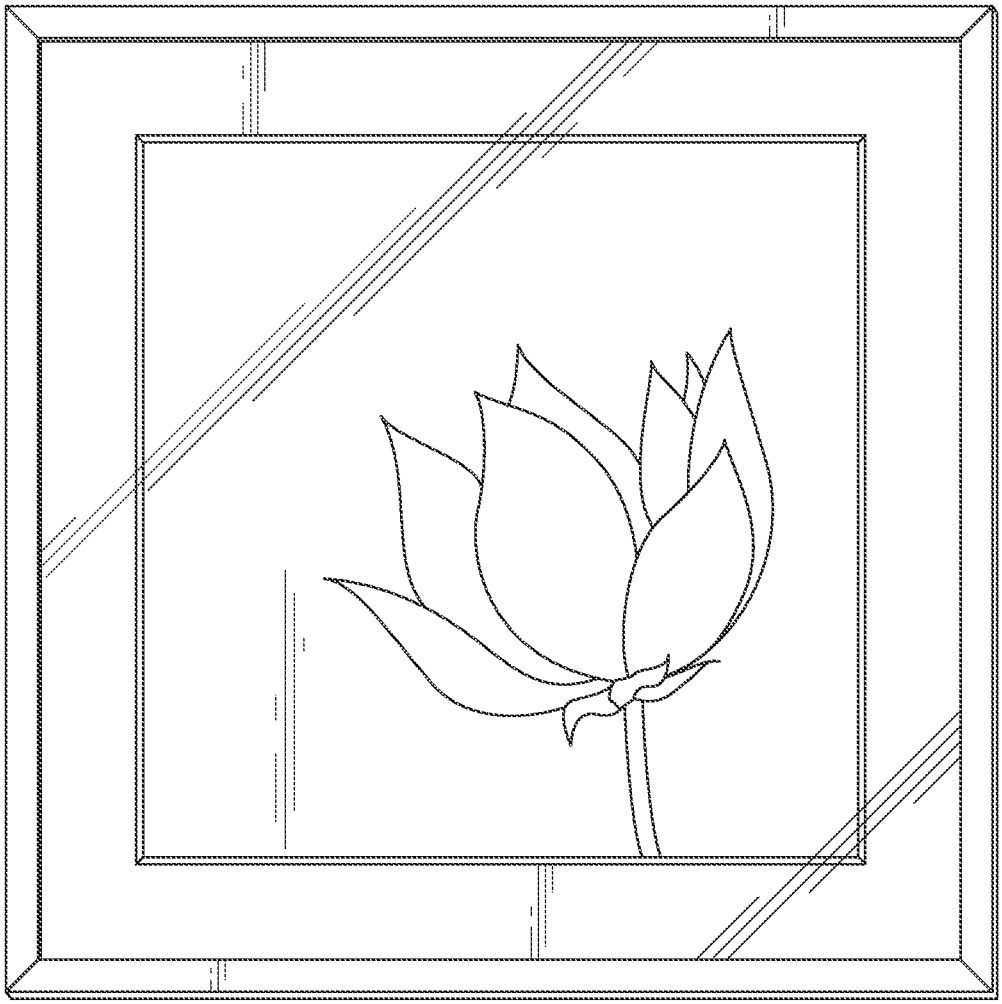
FIG. 12 is a front elevation view of one magnetic framing system.
Figure 13:
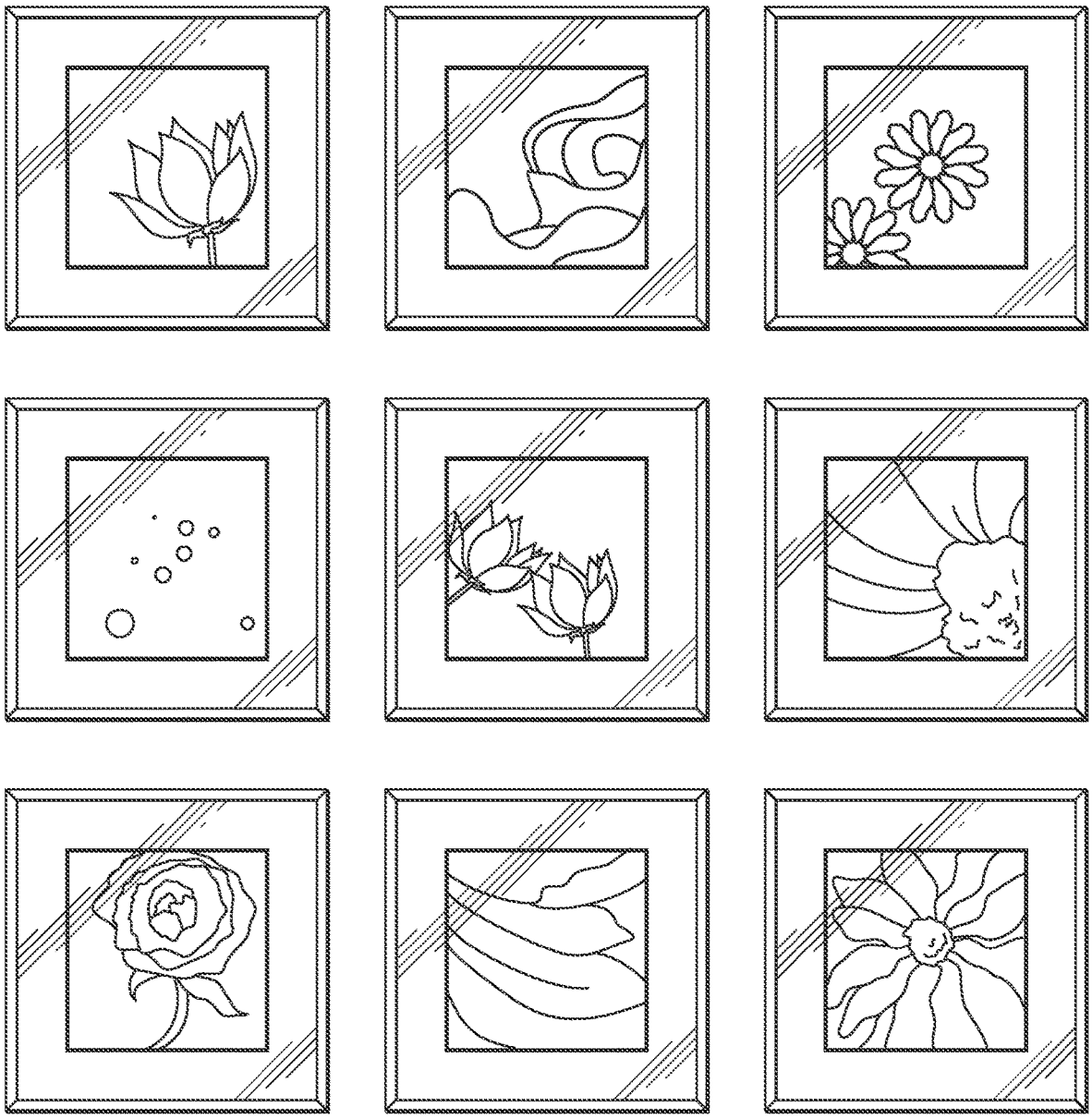
FIG. 13 is front elevation view of an array of magnetic framing systems along a support surface such as a wall.

Accessory Tool (FIG. 3)

As shown in FIG. 3, a "plus shaped" tool 300 (e.g., a structure made from foam or a corrugate) with removable (repositionable/restickable) adhesive applied to a rear face thereof can be used as a guide to align and position a plurality of frames along the wall.

The tool 300 is thus sized to allow positioning of the frames and more specifically, the tool defines four separate quadrants (numbered 1-4) in which four frames can be positioned. The dimensions (e.g., width) of the legs of the tool define the spacing (distance) between adjacent positioned frames. In other words, the greater the width of the legs of the tool 300, the greater the spacing between the frames. The tool is thus placed in a desired location on the wall and is held in place by its repositionable adhesive formed along the rear face thereof. As mentioned, four discrete quadrants 1-4 are defined by the legs of the tool and frames can be placed in one or more of those quadrants, whereby precise positioning between the frames is ensured.

The tool 300 can optionally include a bubble level 400 to perfectly space/align the frames to each other. The bubble level 400 can be placed in the center region of the tool as shown in FIG. 3.

2. Frame Wall Locking Feature:

The majority of walls found in homes and offices, upon which frames are traditionally displayed, are composed of sheetrock which has been coated with paint applied by traditional rollers. The nap/raised (fuzzy) surface of the roller produces a permanent texture on the dry painted wall. Custom designed Injection molds to form the frames, will feature a unique texture 250 to be molded into the rear portion of the frame (preferably at the corners) which contact the wall when attached with the magnetic/adhesive mounting system. The painted wall texture is typically of a cratered concave nature. The texture molded into the frame is convex in nature, designed to mate into the texture of the roller painted wall. After the aforementioned magnetic/adhesive attachment system is utilized to attach subject frame to the wall and desired final positioning has been achieved, it's desirable to lock the frame in place. This locking feature is achieved by pressing the four corners of the frame towards the wall. This enables the convex texture molded into the rear of the frame to seat into the concave texture of the painted wall. The magnetic forces pulling the frame toward the magnetic receptive pad on the wall, work in conjunction with the texture mating system, to maintain the interlocking state of the wall and frame textures, which results in locking the frame in place and minimizes casual shifting on the wall.

To increase the forces interlocking the two textures (on wall and frame), the magnetic rubber component on the rear of the frame may also be slightly recessed from the surrounding frame surface contacting the wall, which will cause the foam material to which the magnetic receptive component is laminated to have to stretch slightly to maintain magnetic contact with the magnetic pad on the frame. The foam under tension will provide frame pulling forces back toward the wall.

The locking texture can be preferably molded into the backside of the four corners of the frame protruding above the surrounding portion of the frame so that the magnetic forces pulling the frame in against the wall would be concentrated at the corners to enhance the function of the locking textures process.

3. Printed Bevel Graphic and Over Laminate to Create "Faux Mat"

Traditional photo and art framing often utilize chipboard mats that are bevel cut on a 45 degree with the center portion removed to display the art beneath it and provide a quiet zone between the art and the edge of the frame. This acts to enhance the focus of the viewer on the art and provides a more artistic display. In an effort to reduce costs and weight for implementation of the framing mounting system, the traditional mat has been eliminated as well as the protective glass covering. In its place, a system has been created to provide the optical illusion that a mat and protective covering have been utilized in the Stick-it frame. To achieve this illusion, a "bevel graphic" has been custom developed with gray shadowing, gradated toning and square defined corners. For an 8"×8" frame an unprinted 1" white boarder is utilized between the frame edge and the printed portion of the photograph. Between the 1" unprinted boarder and the printed photograph, a 1/16" "bevel graphic" is printed surrounding the printed photograph. The surrounding bevel graphic is simultaneously printed with the photographic image on photo paper and then is overlaminated with a clear plastic film which completes the faux mat illusion. The printed photograph appears to be recessed behind a mat and the mat appears to be under a plastic protective sheet often used in the framing profession. The effect is to provide the illusion of depth in the framing and optically simulate the appearance of traditionally framed images.

4. Repositionable Adhesive:

The pressure sensitive adhesive utilized for part A of the frame hanging system (attached to wall) is a specially formulated adhesive designed to firmly adhere to all painted and other type wall finishes. What makes it special is that it's custom formulated to enable films coated with this adhesive to adhere strongly, yet easily peeled from surfaces it has been applied to without any damage occurring (no removal of paint or paper laminate from sheetrock). This adhesive strength builds up to 24 hours but then stabilizes to allow for the easy removal from surfaces into the future. The special adhesive is toll coated to one side of a thin carrier film preferably 1 mm. The 2nd side of the film is coated with a permanent adhesive for laminating the film to foam rubber material which has the magnetic respective rubber laminated to the other side. The foam enables the magnetic receptive material on the foam to adjust to the textured surfaces of painted walls to maximize percentage of surface contact.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A repositionable frame system comprising:

a repositionable wall mount configured for being repositionably secured to a support surface, the repositionable wall mount including a first magnetic element; and a frame having a rear face that includes a second magnetic element that is magnetically attracted to the first magnetic element resulting in a magnetic coupling between the frame and the repositionable wall mount;

wherein the repositionable wall mount includes a carrier layer having a first face and an opposite second face, the first face being coated with a repositionable adhesive for contacting the support surface, the second face being coated with a permanent adhesive that is permanently bonded to the first magnetic element; and wherein the first magnetic element comprises a layer of foam that is permanently bonded to the permanent adhesive of the second face and a magnetically receptive rubber layer that is permanently bonded to the layer of foam.

2. The frame system of claim 1, wherein the magnetically receptive rubber layer comprises a mixture of rubber with ferrous material.

3. The frame system of claim 2, wherein the ferrous material is extruded into the rubber.

4. The frame system of claim 1, wherein the second magnetic element comprises a magnet.

5. The frame system of claim 4, wherein the magnet is produced by a ferrite magnet material mixed with a rubber binder which is then extruded or calendared to form the magnet.

6. The frame system of claim 4, wherein the magnet is attached to the rear face with the permanent adhesive.

7. The frame system of claim 4, wherein the rear face has a recessed portion in which the magnet is placed.

8. The frame system of claim 1, wherein the first magnetic element comprises a permanent magnet and the second magnetic element comprises ferrous material.

9. The frame system of claim 1, wherein the frame includes a rear backing plate that is formed of plastic and includes a molded recessed portion in which the first magnetic element sits.

10. The frame system of claim 1, wherein the frame includes a rear backing plate that is formed of paper to which the first magnetic element is permanently bonded.

11. A kit for mounting two or more frame systems to a support surface comprising:

a plus-shaped tool that includes four legs that define four quadrants, the tool including a bubble level for orienting the tool in a level position relative to the support surface; and wherein each of the two or more frames comprises:

a repositionable wall mount configured for being repositionably secured to a support surface, the repositionable wall mount including a first magnetic element; and a frame having a rear face that includes a second magnetic element that is magnetically attracted to the first magnetic element resulting in a magnetic coupling between the frame and the repositionable wall mount.

12. The kit of claim 11, wherein the tool is formed of foam and includes a repositionably adhesive layer on a rear face thereof for being placed in contact with the support surface.

13. The kit of claim 11, wherein lengths of the legs are less than each of a width and length of the frame.

14. The kit of claim 11, wherein the legs are formed 90 degrees apart from one another.

15. A repositionable frame system comprising:

a first part that is configured for being repositionably secured to a support surface, the first part including a first magnetic element defining a first face of the first part and a repositionable adhesive that is temporarily covered by a release layer that defines a second face of the first part prior to mounting to the support surface; and a second part that includes a frame having a rear face that includes a second magnetic element that is magnetically attracted to the first magnetic element resulting in a magnetic coupling between the frame and the repositionable first part;

wherein the first part includes a carrier on which the repositionable adhesive is layered along a first surface, with a second surface thereof being permanently bonded to a layer of foam to which the first magnetic element is permanently bonded.

16. The frame system of claim 15, wherein the first magnetic element comprises a rubber layer with a ferrous material incorporated therein.

17. The frame system of claim 16, wherein the second magnetic element comprises a magnet.

18. The frame system of claim 15, wherein the carrier comprises a plastic film.

* * * * *